United States Patent [19]

Leupold et al.

[11] Patent Number: 4,764,743

[45] Date of Patent: Aug. 16, 1988

[54] PERMANENT MAGNET STRUCTURES FOR THE PRODUCTION OF TRANSVERSE HELICAL FIELDS

[75] Inventors: Herbert A. Leupold, Eatontown; Ernest Potenziani, II, Ocean, both of N.J.

[73] Assignee: The United States of America as represented by the Secretary of the Army, Washington, D.C.

[21] Appl. No.: 113,293

[22] Filed: Oct. 26, 1987

[51] Int. Cl.[4] ..... H01F 7/02

[52] U.S. Cl. ..... 335/306; 335/212

[58] Field of Search ..... 335/211, 212, 301, 304, 335/306

[56] References Cited

U.S. PATENT DOCUMENTS 3,067,365 12/1962 Sailor et al. ..... 335/212

3,643,311 2/1972 Knetchtel et al. ..... 335/306 X

*Primary Examiner*—George Harris

*Attorney, Agent, or Firm*—Sheldon Kanars; Maurice W. Ryan

[57] ABSTRACT

Permanent magnet structures in several alternative forms are fabricated from multiplicities of permanent magnet segments of magnetic materials, preferably rare earth compounds, with the segments displaced radially from each other progressively along the structures elongate axes so as to produce a heliform magnetic field extending centrally in a passage through the structure.

8 Claims, 3 Drawing Sheets

Figure 4:
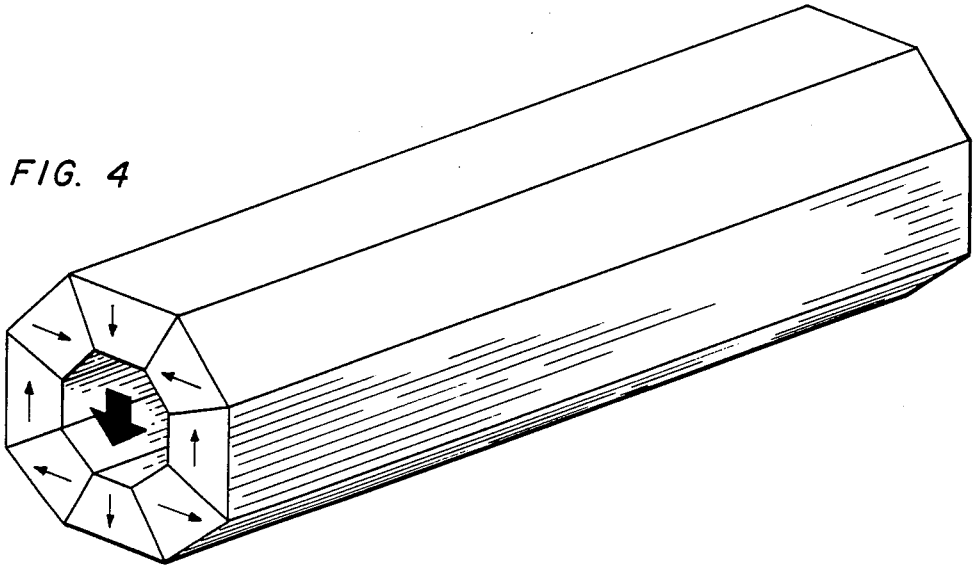

FIG. 1
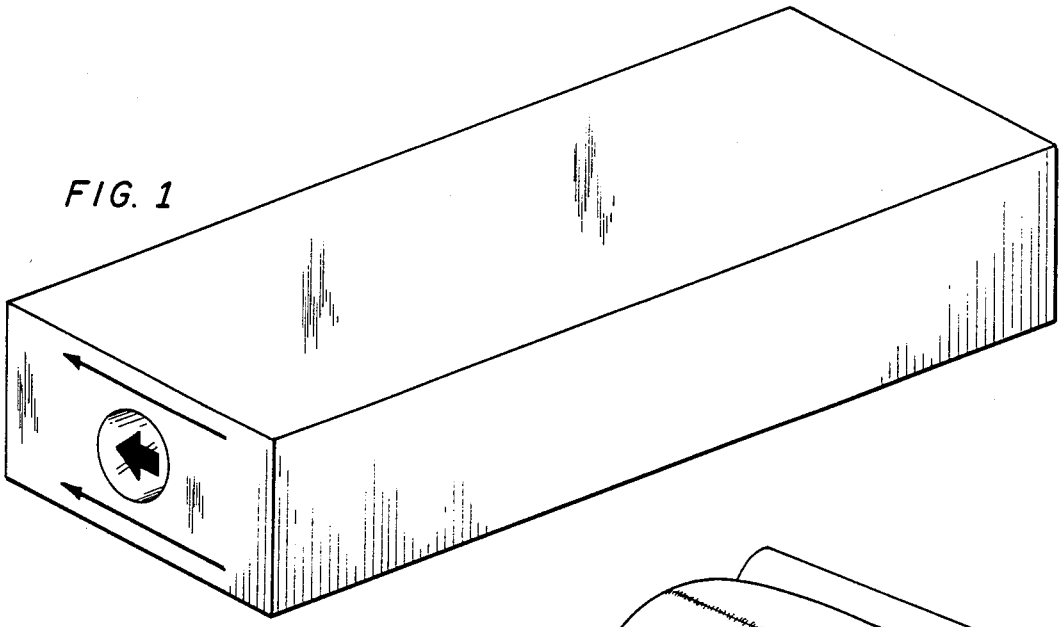
FIG. 2
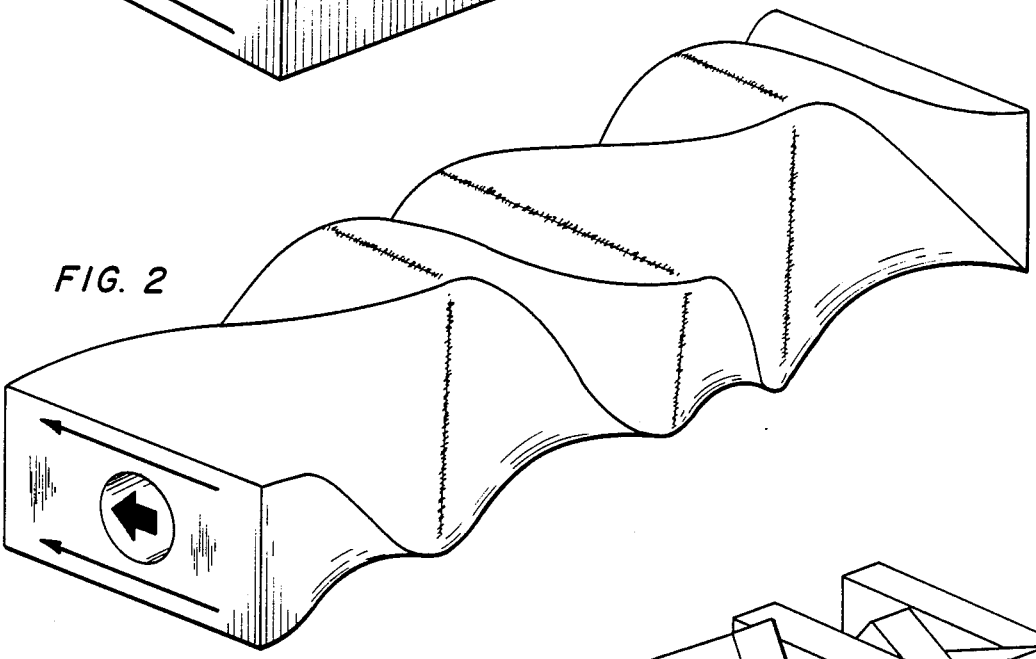
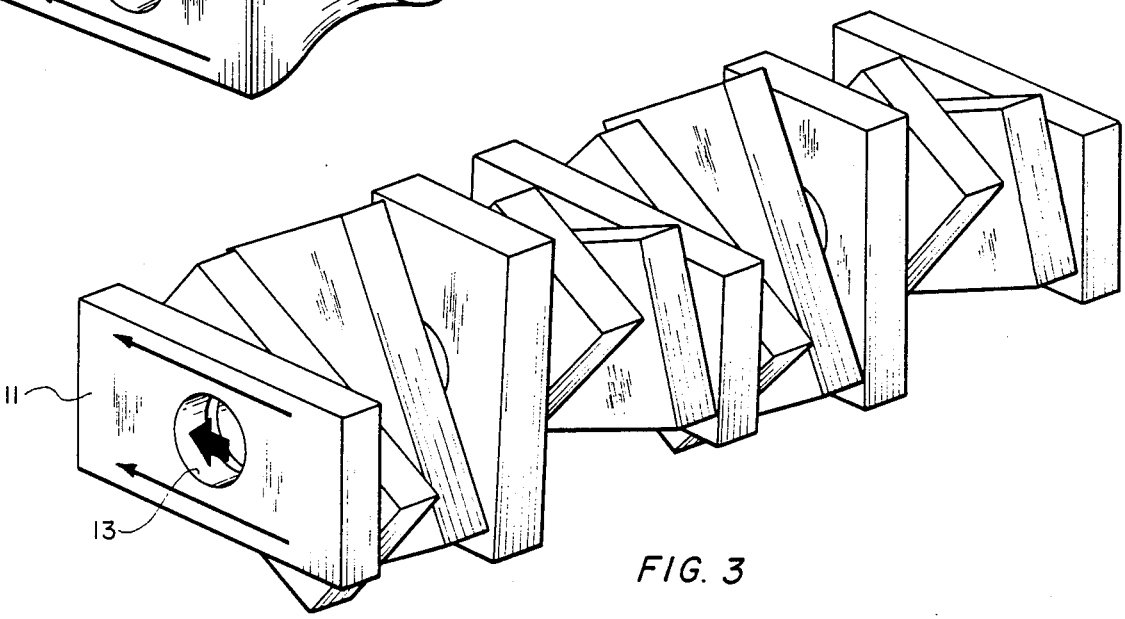
FIG. 3

FIG. 7
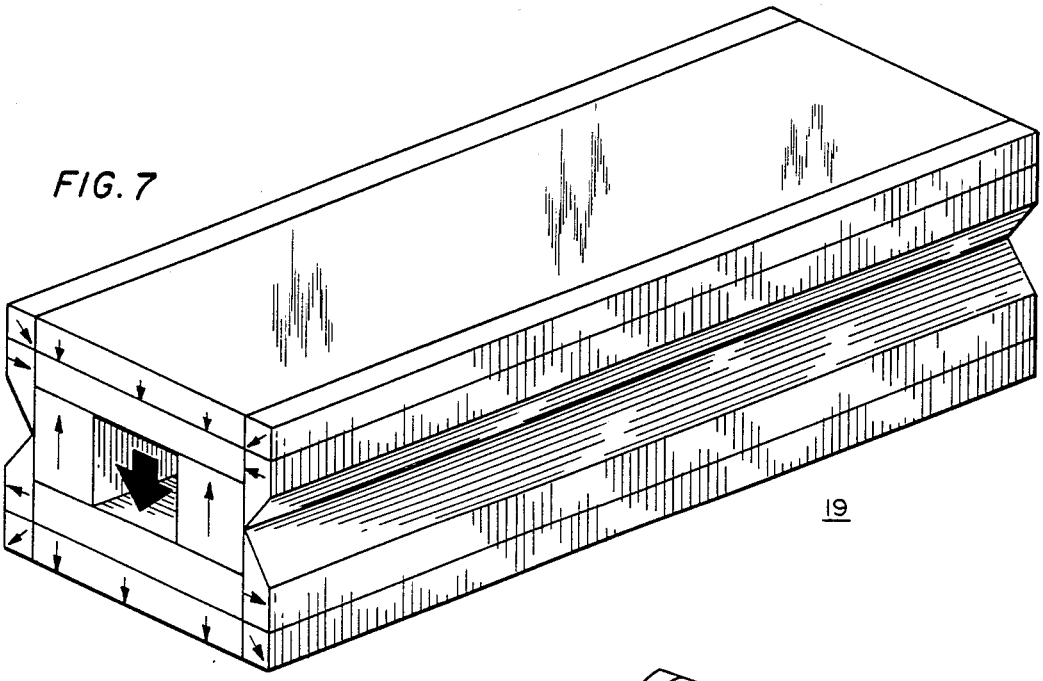
FIG. 8
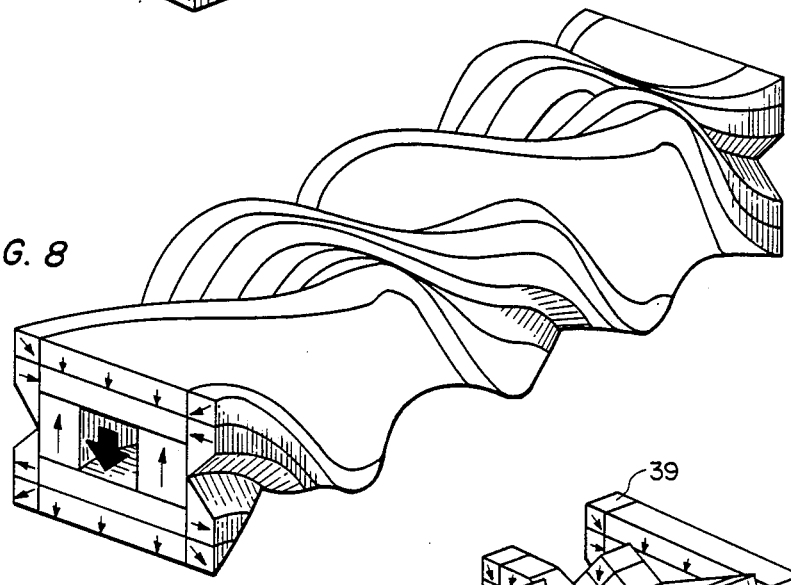
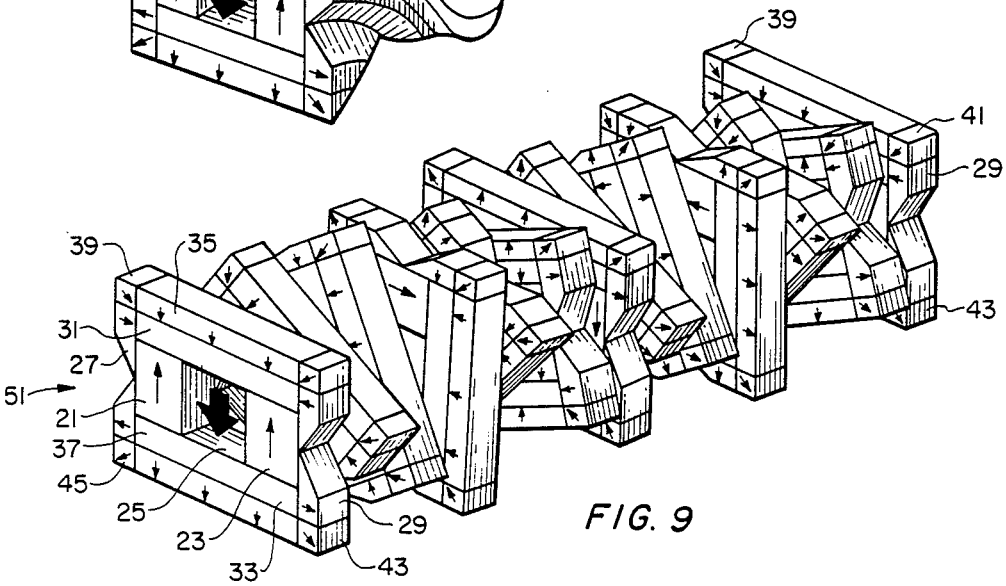
FIG. 9

PERMANENT MAGNET STRUCTURES FOR THE PRODUCTION OF TRANSVERSE HELICAL FIELDS

The invention described herein may be used, manufactured, and licensed by of for the Government of the United States of America for governmental purposes without the payment to us, or any of us, of royalties thereon.

BACKGROUND AND FIELD OF THE INVENTION

The present invention relates to the utilization of permanent magnets to produce helically oriented magnetic fields which are particularly useful in circularly polarized microwave/millimeter-wave devices in electronics work. The utilization of high power, broad-band radiation sources for microwave and millimeter-wave radars is particularly enhanced by the availability and inclusion of helical undulator or twister designed magnetic field generators. These effects have been achieved, prior to the time of the present invention, by means of current carrying coils of very high amperage adapted to produce a helically varying transverse magnetic fields of the magnetization desired. By the use of permanent magnet structures of particularly designed geometries in accordance with the present invention, the need for current carrying coils and the attendant weight and space problems have been obviated.

In several earlier inventions, notably U.S. Pat. No. 4,654,618, Mar. 31, 1987, and U.S. Pat. No. 4,658,228, Apr. 14, 1987, the effective utilization of rare earth permanent magnetic materials for the effective replacement of ferrite permanent magnets and/or electromagnets for the effective containment and control of electron beams without any substantial loss of field flux for applications in miniaturized magnetic devices in communications circuits and the like is taught. The '228 patent discusses the confinement of longitudinal axially symmetric magnetic fields and confining these fields with great precision to annular regions within permanent magnetic structures. The '618 patent teaches the confinement of magnetic field to very small areas in miniature devices. Both of these patents teach the basic concept of using particularly formed and especially shaped cladding magnets and the use of rare earth compound materials as effective magnetic substitutes for straight ferrites and what is more important, for electromagnetic devices.

The basic teachings concerning the methods by which rare earth materials are put into place in magnetic elements and devices and which are described with great particularity in the two aforementioned patents, are incorporated by reference as teachings in this disclosure.

With the above-described need for the production and control of helically oriented flux fields, we conceived and developed the present invention to provide for the application of permanent magnets made of the rare earth compound materials designed and arranged in certain specific ways in order to produce the desired helical or "twisted" fields without the need for large and bulky ferrite magnets and/or electromagnetic elements.

It is, therefore, a primary object of this invention to provide permanent magnet structures made of rare earth compound materials which can effectively produce magnetic fields which are helically defined and oriented to control the passage of electrons therethrough accordingly.

It is a further object of this invention to provide for the application of cladded magnet structures in this unique and advantageous way for the production of the desired helical magnetic flux fields.

A further and important object of the invention is to attain by approximation as accurately as possible the form of an ideal or idealized structure which, because of its nature, would be extremely difficult, if not impossible, to structurally produce by any presently known fabrication or assembly means.

Figure 5:
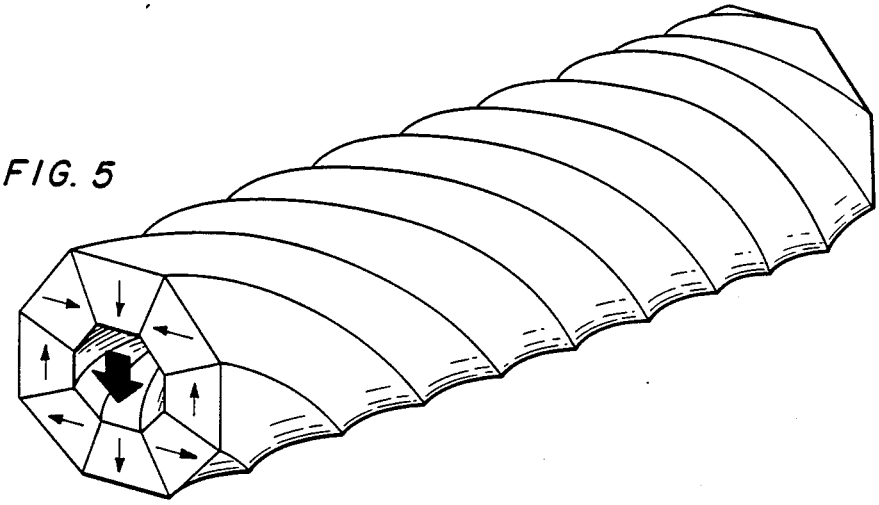

These and other objects, features, and details of the invention will become the more readily apparent in light of the ensuing detailed description and disclosure, particularly in the light of the drawing wherein:

FIGS. 1, 2, and 3 show, successively, in perspective view, the basic magnetic structure, the ideal structure, if such could be attained in reality, and the actual structure according to the invention of a first embodiment of apparatus according to the invention;

FIGS. 3, 4, and 5 show, successively, a basic structure of a magnet, the idealized version of same if such could be attained in reality, and the actual structure of the apparatus according to the invention, all in perspective view, of a second embodiment of apparatus according to the invention; and FIGS. 7, 8, and 9 show, successively, a basic cladded magnet structure, the idealized version of a magnet according to the invention if such could be attained in reality, and the actual apparatus according to the invention, all in perspective view.

SUMMARY OF THE INVENTION

In general, the invention comprehends a permanent magnetic structure, most advantageously made of rare earth compound materials, to produce a helically oriented magnetic field, which structure comprises, in combination, a multiplicity of similarly magnetized polyginal magnet segments, each having a generally centrally disposed hole therethrough, arranged concentrically on an elongate axis with said holes defining an elongate axial passage extending through said structure, each respective of said similarly magnetized magnetic segments displaced radially on said elongate axis from its adjacent respective segments and, means to hold the combination in structurally integral condition.

In one embodiment of apparatus according to invention, each polyginal shaped element is formed of a rectangle or square and each such element is rotated slightly radially with respect to its adjacent similar elements as shown in FIG. 3.

In an alternative embodiment of apparatus according to the invention, each polyginal element is octagonal in form, with each respective octagonal segment rotated radially on the axial center line so as to displace its magnetization along a helical locus, thus giving the entire array the capacity to define a twisted or helically oriented magnetic field through the axially extending center passage.

In a still further and preferred embodiment of apparatus according to the invention, the individual polyginal elements are cladded magnet structures, each segment being defined substantially as shown by the flux arrow designations in FIG. 9 of the drawing. In this embodiment, similarly, each respective segment or individual magnetic element is rotated radially with respect to its adjacent elements so as to define the desired twisted or helical field extending through the middle passage of the array. DETAILED DESCRIPTION OF THE INVENTION FIG. 1 of the drawing shows, as a potential replacement for a coil and its power supply, a simple untwisted bar magnet structure, rectangular in cross section and with an axially disposed central passage extending longitudinally therethrough.

FIG. 2 shows the idealized structure of this magnet altered to produce a helical interior field, that is to say the magnet shown in FIG. 1 is twisted by the application of torsional force so that, ideally, it would take the shape and definition shown in FIG. 2 of the drawing. This shape, is, of course, not realistically attainable in present day production methods so that it is necessary to go to an approximation of the structure and this is shown in FIG. 3.

FIG. 3 of the drawing shows a multiplicity of polygonal magnet segments 11, each having a generally centrally disposed hole 13 arranged in longitudinal array with the respective holes 13 concentrically in registration, and with each respective segment 11 displaced radially a preselected amount from its adjacent segment so that the magnetic orientation of the respective segments as the field is defined longitudinally through the extended passage 13 goes through a twisting locus from the proximal end towards and to the distal end. The net effect of the arrangement is the production of a helically varying or twisting magnetic field through the array of passages 13.

Figure 6:
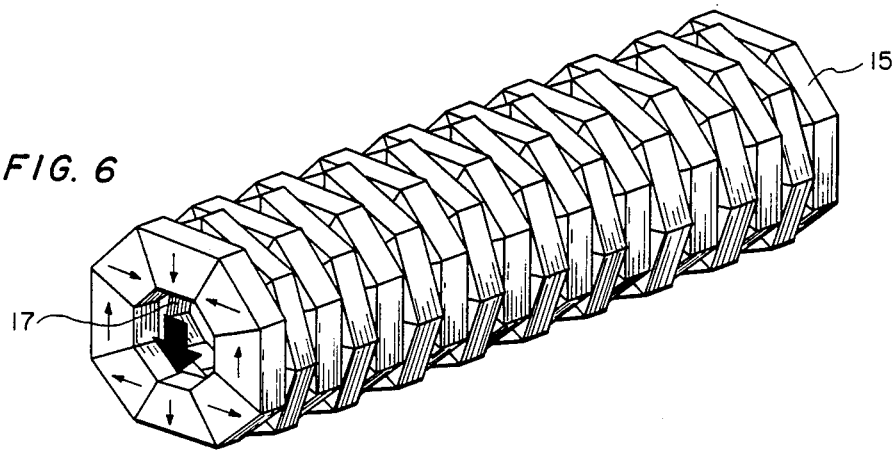

FIG. 4 of the drawing shows a structure originally suggested by Halbach in proceedings of the Eighth International Conference on Rare Earth Magnet Materials, Univ. of Dayton, Dayton Ohio, 1985, p. 123. The structure comprises a multiplicity (eight as shown) of elongate trapezoidal cross section bar magnets arranged to define a polygonal cross section (an octagon as shown) magnet array having an elongate passage 17 extending centrally therethrough. In accordance with our invention, the structure could theoretically be twisted to the configuration shown in FIG. 5, an idealized version of the octagonal cross section bar magnet array altered to produce a helical field. The practical attainment of the idealized structure according to FIG. 5 would be such as seen in FIG. 6 where each of the individual segments 15 arrayed along a concentric longitudinally extended axis would be moved radially to displace adjacent particular field magnetizations so as to produce the overall effect of a helically varying or twisted field through the centrally extended passage 17 running from the proximal end towards and to the distal end of the magnet as shown.

The basic cladded magnet 19 structure is shown in FIG. 7 of the drawing. The basic total structure of the cladded magnet 19, as well as each individual segment thereof as shown in FIG. 9 of the drawing, comprises the main flux carrying magnets 21, 23 arranged to produce the basic and major flux fields in the central opening 25 extending through the magnet, cladding magnets 27, 29 coextending longitudinally with the main magnets 21, 23, pole pieces 31, 33, bucking magnets 35, 37, and corner pieces 39, 41, 43, 45. The idealized or twisted version of this structure is shown in FIG. 8.

FIG. 9 shows the arrangement of individual segments 51, each comprising an array of sectionalized elements as described for FIG. 7 hereinabove. The net effect of this arrangement is to produce a helically varying field through the opening 25 longitudinally through the magnet from one end to the other.

In the above-described embodiment the design criteria upon which the structures are based presupposes that the working space to which a field is to be applied is just large enough to circumscribe a right circular cylinder 1.7 cm in diameter. It is also assumed that rare earth permanent magnets are used which have a remanence of Br=10 kG.

When a laterally magnetized bar with a coaxially extending cylindrical passage is twisted about its longitudinal axis as shown for instance in FIGS. 2 and 5 of the drawing, the on-axis transverse field can be determined by calculating the pole density $\sigma$ on the surfaces with the expression $$\sigma=\hat{m}.\vec{M}$$

and then inserting $\sigma$ into Coulomb's Law and integrating over the surfaces.

It is further assumed that the magnet bar lengths are infinite for the purposes of the computation, the heights are 0.4 cm greater than the diameter of the cylindrical hole, and the bar cross-sectional widths or depths may be varied.

For such an assumed bar structure without any twist or helical deformation imparted thereto, magnetization perpendicular to the planar surfaces will produce a field $4\pi M$ due to poles on the parallel outer surfaces, and one of $-2\pi M$ due to the poles on the surface of the cylindrical hole interior of the array, resulting in a net field of $2\pi M$. If the direction of magnetization is parallel to the planar surfaces there are no planar charges and only the cylindrical surfaces contribute to a field of $-2\pi M$.

A reduction in field and therefore less magnetization, occurs when such structures are twisted to produce the helical field effect.

Experimentation and calculations show that the magnetic poles along the cylindrical or work passage boundary passing centrally through the structure contribute most to the net magnetic field. The increase in mass by making the structures wider or taller or of greater overall diameter has discernibly less effect since the outward planar poles recede from the axis and produce less field to counteract the greater effect of the inner cylindrical wall poles.

Turning to the cladded structure shown in FIGS. 7, 8, and 9 of the drawing the main magnets 21, 23 must be of cross-sectional area $A_w$ sufficient to provide enough flux to provide the desired uniform field $H_w$ within the working space, passage 25. Thus, $$2A_m=A_wH_w/B_m$$

where $B_m$ is determined by the demagnetization curve of the magnets used, $A_w$ is the cross-sectional area of the work space in $cm^2$ and $H_w$ is the field in kiloOersteds.

$$B_m=H_m+4\pi M=H_m+B_r$$

Applying Maxwell's equation at the inner surface of the main magnets, $H_m$ is found to equal the negative of the desired field magnitude $-|H_w|$, so that the above equation becomes $$B_m=-|H_w|+10$$

and thus $A_m$ may be determined.

The details of attaining the necessary design characteristics of the remaining portions of cladded magnets are in the literature, specifically, in "Permanent Magnets for Magnetic Resonance Imaging," Potenziani and Leupold, IEEE Transactions on Magnetics, Vol. Mag-22, No. 5, September 1986, (pub. 10/28/86). The details of computation for cladded magnet structures are found in the aforementioned patents which are incorporated by reference as indicated hereinabove. The total flux per unit length of the cladded magnet structure required to provide the desired transverse field after twisting, or practically speaking, as produced by the structure shown in FIG. 9 of the drawing, can be determined by calculations which are within the skills of persons familiar with the art. In brief, noting that the pole pieces constitute equipotential surfaces and that the magnetic field flux lines are normal to these, the magnitudes of the field components will be in the ratio of the direction cosines of the surfaces. Since the magnetization $H_w$ in the work space is specified by design criteria, and the other two components are also specified, the total flux leaving either surface can be calculated and the total flux per unit length of the structure found by known mathematical formulas.

In practice it has been found that the bar magnet arrangement shown in FIG. 3 is by far the simplest and least expensive of the embodiments of apparatus according to our invention. It has fewer parts and is more mechanically robust. It is therefore considered to be the preferred embodiment of apparatus according to our invention.

The cladded structure produces the smallest maximum fields and is by far the most expensive. It does however short out solenoidal focusing fields in the operation zones which may be superimposed from the outside. It will therefore have its uses in certain given discrete applications.

In the light of our foregoing description, numerous alternative embodiments of apparatus according to our invention will doubtless occur to persons skilled in this art. It is therefore intended that the description be taken as illustrative only and not construed in any limiting sense, it being our intent to define the invention by the appended claims.

What is claimed is:

1. A permanent magnet apparatus to produce a helically oriented magnetic field comprising, in combinations;

a multiplicity of polygonal similarly magnetized magnet segments, each having a generally centrally disposed hole therethrough, arranged concentrically on an elongate axis with said holes in substantial registration along said axis to define an elongate axial passage extending through said apparatus;

each respective said similarly magnetized magnet segment displaced radially on said elongate axis from its respective adjacent segment.

2. Apparatus according to claim 1 wherein each similarly magnetized segment comprises a relatively short length of a rectangular cross sectioned bar magnet with an axial passage extending substantially centrally therethrough.

3. Apparatus according to claim 1 wherein each similarly magnetized segment comprises a relatively short length of an array of trapezoidal cross-sectioned elongate bar magnets arranged and disposed to define a polygonal cross-section with an elongate axial passage extending centrically therethrough.

4. Apparatus according to claim 1 wherein each similarly magnetized segment comprises a relatively short length of an array comprising bar magnets, cladding magnets, bucking magnets, pole pieces, and ring elements, arranged and disposed to define an axial passage extending substantially centrally therethrough and wherein magnetic flux produced by said bar magnets is maintained in substantially uniform density by said cladding magnets, bucking magnets, pole pieces, and ring elements.

5. Apparatus according to claim 1 wherein said magnet segments comprise rare earth compound material.

6. Apparatus according to claim 2 wherein said magnet segments comprise rare earth compound materials.

7. Apparatus according to claim 3 wherein said magnet segments comprise rare earth compound materials.

8. Apparatus according to claim 4 wherein said magnet segments comprise rare earth compound materials.

* * * * *